US007669468B2

(12) United States Patent
Wraight et al.

(10) Patent No.: US 7,669,468 B2
(45) Date of Patent: Mar. 2, 2010

(54) MEASURING MUD FLOW VELOCITY USING PULSED NEUTRONS

(75) Inventors: Peter Wraight, Skillman, NJ (US); Roger Griffiths, Abu Dhabi (AE); Kenneth Stephenson, Newtown, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 931 days.

(21) Appl. No.: 10/539,465

(22) PCT Filed: Nov. 21, 2003

(86) PCT No.: PCT/EP03/13142

§ 371 (c)(1),
(2), (4) Date: May 2, 2006

(87) PCT Pub. No.: WO2004/059125

PCT Pub. Date: Jul. 15, 2004

(65) Prior Publication Data

US 2006/0254350 A1 Nov. 16, 2006

(30) Foreign Application Priority Data

Dec. 31, 2002 (EP) ..... 02293280

(51) Int. Cl.
*G01N 23/00* (2006.01)

(52) U.S. Cl. ..... 73/152.14

(58) Field of Classification Search ..... 73/152.14
See application file for complete search history.

(56) References Cited

U.S. PATENT DOCUMENTS

| | | | | |
|---|---|---|---|---|
| 3,691,378 | A * | 9/1972 | Hopkinson et al. | 250/264 |
| 4,233,508 | A | 11/1980 | Arnold | |
| 5,219,518 | A * | 6/1993 | McKeon et al. | 376/166 |
| 5,469,736 | A * | 11/1995 | Moake | 73/152.58 |
| 5,486,695 | A * | 1/1996 | Schultz et al. | 250/261 |

FOREIGN PATENT DOCUMENTS

EP 0645520 3/1995

* cited by examiner

*Primary Examiner*—Hezron Williams
*Assistant Examiner*—Rodney T Frank
(74) *Attorney, Agent, or Firm*—Darla Fonseca; Jaime Castano; Dale Gaudier

(57) ABSTRACT

The invention relates to methods and apparatus for determining downhole mud flow rates and other downhole parameters. A method for determining a downhole parameter includes operating a pulsed neutron generator (6), pulsing the pulsed neutron generator (6) off, detecting a substantially unactivated drilling fluid slug at a known distance (d) from the pulsed neutron generator (6), and determining a time-of-flight (t) for the unactivated drilling fluid slug to travel from the pulsed neutron generator (6) to a detection point.

19 Claims, 4 Drawing Sheets

MEASURING MUD FLOW VELOCITY USING PULSED NEUTRONS

BACKGROUND OF INVENTION

When drilling a borehole through a geologic formation, it is important to know the downhole conditions to ensure that the drill bit is operating correctly. These conditions include, among others, the diameter of the borehole and, therefore, the volume of the drilling fluid at any given point. In addition, the formation properties are measured to predict the presence of oil or gas. Formation properties may be logged with wireline tools, logging while drilling (LWD) tools, or measurement while drilling (MWD) tools. Modern oil and gas explorations typically use LWD or MWD tools, instead of wireline tools, for formation logging due to the saving in time and costs.

Various LWD and MWD tools are in use for measuring borehole or formation properties. For example, LWD neutron or gamma spectroscopy logs are used to provide lithology, formation porosity, and formation density information. Neutron/gamma spectroscopy is often performed by sending a pulse of neutrons into the formation using a pulsed neutron generator (PNG). The neutrons interact with elements in the formation by inelastic interactions or elastic interactions. The high-energy neutrons gradually lose their energy through these interactions to become thermal neutrons, which may be captured by the nuclei of various elements in the formation. After neutron capture, these elements become activated. The activated elements then decay by emitting gamma rays. The gamma rays emitted by these activated elements may be detected with gamma ray detectors. Because different elements produce gamma rays of different energies, the captured gamma ray spectra may be used to derive the elemental compositions of the formation. The elemental yields in turn may be used to provide formation lithology because different sediment layers are typically enriched with different types of elements. Methods for neutron and gamma ray logging are well known in the art. Detailed descriptions may be found in, for example, U.S. Pat. No. 5,440,118 issued to Roscoe, U.S. Pat. No. 5,786,595 issued to Herron et al., and U.S. Pat. No. 5,539,225 issued to Loomis et al. See also Albertin et al., "*The many facets of pulsed neutron cased-hole logging*," Schlumberger Oilfield Review, v. 8, no. 2, p. 2841, 1996.

However, various LWD or MWD tools used in formation logging are adversely affected by the presence of drilling fluids (muds) and their sensitivities are typically compromised by tool "stand offs," i.e., the distances from tools (or sensors) to the borehole wall. For example, chloride ions in the drilling muds may interact with (capture) thermal neutrons with high efficiency reducing the sensitivity of the gamma spectroscopy. Therefore, LWD measurements often need to be corrected for the adverse effects from the drilling fluids or tool stand offs. To correct the effects of the drilling muds or tool stand offs, it is necessary to determine the borehole diameters, tool stand offs, or the mud hold up volumes at the sites of measurements while the borehole is being drilled.

Borehole diameters are typically measured using caliper tools. Various caliper tools are available in the art. However, most of these tools are useful only as wireline tools; they cannot be deployed while drilling. With wireline tools, these measurements are acquired after the drill strings have been pulled from the boreholes. There would be substantial time lags between the times when the boreholes are drilled and the formations are logged and when the borehole diameters are determined. During this period, the shapes and sizes of the boreholes might have changed due to borehole instabilities. For this reason, it is desirable that the borehole diameters are measured while the formations are logged during the drilling process. It is also desirable that the processes of determining the borehole diameter not interfere with the normal logging while drilling processes.

Furthermore, large quantities of drilling fluids are pumped through the drill strings into the boreholes while the boreholes are being drilled. The drilling fluids help cool the cutting surfaces of the drill bits and help carry out the earth cuttings from the bottom of the borehole when they flow up the annulus to the surface. To prevent formation fluids from flowing into the borehole during the drilling process, the drilling fluids are pumped under a pressure that is slightly higher than the expected formation pressure. The higher hydraulic pressure of the drilling fluids may result in a substantial loss of fluid into the formation when a permeable and low pressure zone of the earth formation is encountered. Detection of such fluid loss may be used in correction of the measurements of various LWD sensors. Fluid loss into the formation may be detected by the reduced flow back of the drilling fluids on the surface. However, for determining in what zone the fluid loss is occurring, means of detecting volumetric flows along the axial depth of the borehole are needed.

Time-of-flight measurement of activated slugs of fluid have been used in the prior art in connection with the Water Flow Log (WFL). In the WFL service, a slug of mud is activated and then timed over a relatively long duration. In this process, the PNG is normally off, and is activated only very briefly to periodically tag a slug of fluid with a neutron burst. Such a process does not match well with the LWD environment or with neutron tools, where the PNG remains activated most of the time.

Therefore, it would be desirable to have LWD-compatible methods and apparatus for determining fluid time-of-flight, borehole diameter, volumetric flow rate, and various other parameters at a given depth in the borehole.

SUMMARY OF INVENTION

One aspect of the invention relates to methods for determining downhole parameters. A method for determining a downhole parameter in a drilling environment in accordance with embodiments of the invention includes: operating a pulsed neutron generator (6) to activate drilling fluid flowing past the neutron generator; turning off the pulsed neutron generator (6) for a time sufficient to create an unactivated slug of drilling fluid; detecting the unactivated drilling fluid slug at a known distance (d) from the pulsed neutron generator (6); and determining a time-of-flight (t) for the unactivated drilling fluid slug to travel the distance (d). In some embodiments, the method further includes calculating drilling fluid velocity from the time-of-fight (t) and the known distance (d). In some embodiments; the method further includes calculating borehole volume over the distance (d) using a known volumetric flow rate. In some embodiments, the method further includes calculating a downhole volumetric flow rate from the time-of-flight (t) and, a known borehole volume.

Another aspect, of the invention relates to a tool for determining downhole parameters. A tool for determining a downhole parameter in a drilling environment is a tool adapted to be placed in a drill string, wherein the tool has a pulsed neutron generator (6) and a gamma ray detector (7) separated along a drill string axis thereof by a distance d. The tool further includes: control circuitry operable to turn off the pulsed neutron generator (6) for a time sufficient to create an unactivated slug of drilling fluid flowing past the tool; and processing means (17), responsive to the gamma ray detector (7), for determining when the unactivated slug of drilling fluid flows past the gamma ray detector (7), and for determining a time-of-flight (t) for the unactivated drilling fluid slug to travel the distance (d). In some embodiments, the processing means is configured to calculate drilling fluid velocity from the time-of-flight (t) and the known distance (d). In some embodiments, the processing means is configured to calculate borehole volume over the distance (d) using a known surface volumetric flow rate. In some embodiments, the processing means is configured to calculate a downhole volumetric flow rate from the time-of-flight (t) and a known borehole volume.

Other aspects and advantages of the invention will be apparent from the following description and the appended claims.

DETAILED DESCRIPTION

The invention relates to methods and apparatus for determining flow velocities of drilling fluids ("muds") in boreholes. The invention, advantageously, may be used while drilling a borehole. The fluid velocity permits the calculation of other downhole parameters, such as the borehole diameter and the volumetric flow rate of the mud.

In some embodiments, the invention relies on the activation of oxygen in the drilling mud. In the activation process, oxygen atoms in the drilling mud are transformed from stable atoms into radioactive atoms by the bombardment of neutrons. When an oxygen-16 atom absorbs a neutron (neutron capture), it may emit a proton to produce a radioactive nitrogen-16 atom. Nitrogen-16, with a half-life of about 7.1 seconds, decays to oxygen-16 by emitting a beta particle. The oxygen-16 that results from the beta decay of nitrogen-16 is in an excited state, and it releases the excitation energy by gamma ray emission. The gamma ray emission may be detected by a gamma ray detector.

Embodiments of the present invention may be used with an LWD neutron tool with no or minimal interference with normal operations of the tool, i.e., they permit the PNG to be substantially continuously operated for LWD measurements. Neutron logs typically are used to measure the porosity of the formation. In addition, elements in the formation may become activated after capturing thermal neutrons. The activated elements then emit gamma rays when they return to ground states. These gamma rays may be detected with gamma ray detectors for deriving formation density or lithology.

In a normal logging operation, the PNG in a neutron tool is "on" most of the time to generate neutrons for the neutron log measurements. In accordance with the invention, the PNG is pulsed off for a period of time long enough to enable a slug of fluid to pass the PNG without being activated. A gamma ray detector at a known distance from the PNG measures a decrease in the count rate when the unactivated slug of fluid passes the detector. As used herein, an "unactivated slug" means a slug of fluid that passes through the activation region near the PNG while the PNG is pulsed off, even though the unactivated slug may be partially activated by stray neutrons in the borehole or by the PNG when the slug passed the PNG while flowing inside the drill pipe. The unactivated slug has a lower radioactivity than an activated slug, so that a decrease in gamma rays may be detected by the gamma ray detector.

Figure 1:
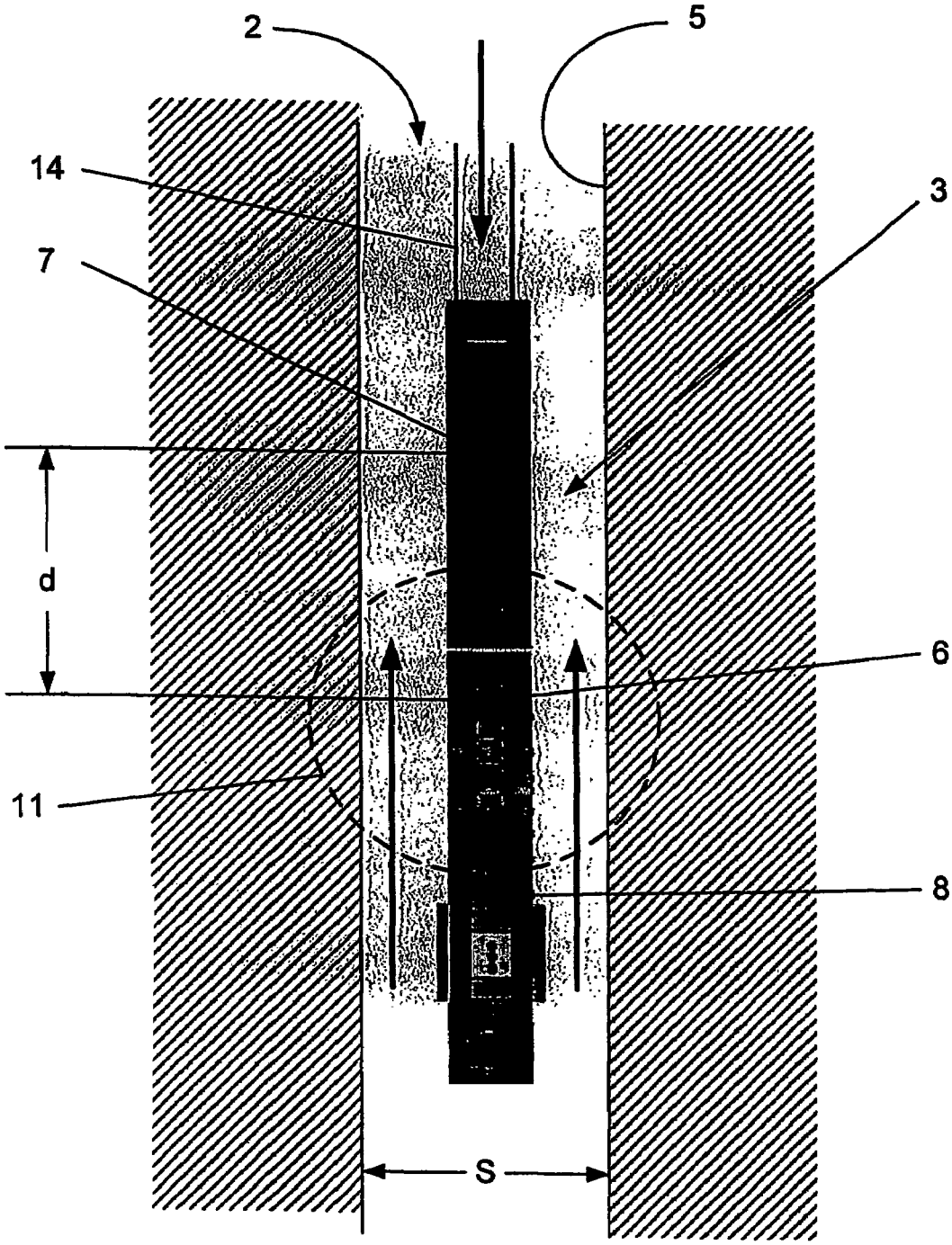
FIG. 1 shows an LWD tool in accordance with one embodiment of the invention.

FIG. 1 shows one embodiment of an LWD tool 3 in a borehole 2. The LWD tool is part of the drill string 14. The LWD tool 3 includes, among other devices, a PNG 6 and a gamma ray detector 7 that are spaced apart by a known distance d. The PNG 6 has an activation zone 11, within which atoms are activated by the neutrons emitted from the PNG 6. As the drilling mud, flowing upward in the annulus between the LWD tool 3 and the borehole wall 5, passes through the activation zone 11, oxygen in the mud is activated. Arrows indicate the direction of mud flow. When the mud passes near the gamma ray detector 7, the gamma rays emitted by the activated oxygen are detected. When the PNG 6 is pulsed off, a slug of mud will pass through the activation zone 11 without being activated. When this unactivated slug reaches the gamma ray detector 7, a decrease in the gamma ray count rate is detected. The time between when the PNG 6 is pulsed off and the detection of the decrease in the gamma ray count rate reflects the time for the unactivated slug to travel from the PNG 6 to the gamma ray detector 7. This time is hereinafter referred to as the "time-of-flight."

The distance d between the PNG 6 and the gamma ray detector 7 should be selected to optimize detection of the unactivated slug. If the distance d is too short, then the detector receives a very large contribution from activated oxygen within the tool. Although this is measurable and repeatable, the statistical variation in the count may make the measurement less accurate. On the other hand, if the distance d is too large, then too much time elapses between when the PNG is pulsed off and when the deactivated slug is detected, thus making the detection unreliable. In general, the distance should be chosen so that for normal flow velocities, d is less than the distance travelled by mud in the annulus in about 30 seconds.

The gamma ray detector 7 may be any conventional detector used in a neutron/gamma ray tool. In this case, the energy windows of the gamma ray detector 7 are set such that gamma rays emitted by activated oxygen are detected. Alternatively, the gamma ray detector 7 may be a specific detector for the gamma ray emitted by the activated oxygen. The mud velocity in the annulus may be calculated using the time-of-flight and the known distance d between the PNG 6 and the gamma ray detector 7. Equation 1 shows one formula for calculating the mud velocity:

$$V_m = \frac{d}{t} \tag{1}$$

Where d is the distance between the PNG 6 and the gamma ray detector 7, t is the time-of-flight, and $V_m$ is the velocity of the mud.

The mud velocity may then be used to compute other downhole parameters. One such parameter is the diameter or volume of the borehole. Another possible parameter that may be computed using the mud velocity is the mud volumetric flow rate.

It should be noted that a slug of mud passing through the activation zone 11 in the annulus may have already passed through the activation zone 11 while flowing downward through the mud channel (not shown) in the LWD tool 3. Typically, this should not affect the time-of-flight measurement as described above for at least two reasons. First, the mud channel has a much smaller flow cross-section than that of the annulus. As a result, mud in the mud channel travels through the activation zone 11 inside the drill string much faster and is activated to a much smaller degree. Second, the half-life of nitrogen-16 is about 7.1 seconds. Thus, only one half of the radioactive nitrogen-16 will remain 7.1 seconds after activation. By the time the mud in the channel flows to the drill bit and returns to the LWD tool through the annulus, much of the radioactivity will have already decayed.

Figure 2:
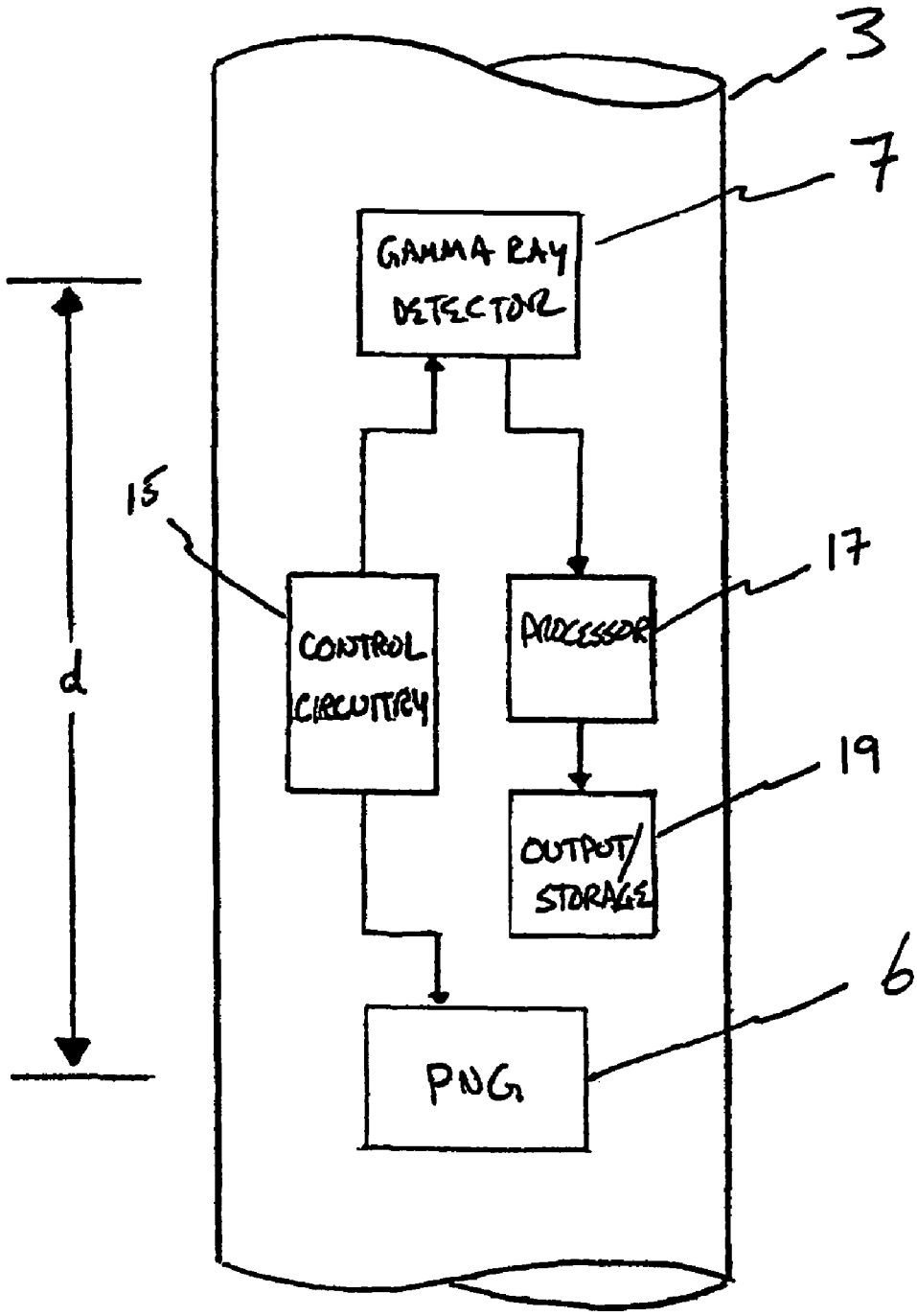
FIG. 2 shows a schematic diagram of circuitry of an LWD tool in accordance with an embodiment of the invention

FIG. 2 shows a schematic representation of a portion of LWD tool 3 of FIG. 1. As noted previously, the LWD tool includes a PNG 6 and a gamma ray detector 7 separated by a known distance "d". In a given commercial implementation of an LWD tool, the tool will include a variety of circuitry, in addition to various other emitters and sensors, depending on the design of the tool. The precise design of, for example, the control and processing circuitry of the LWD tool is not germane to this invention, and thus is not described in detail here. However, at a minimum, it should be understood that the LWD tool 3 will include control circuitry 15 configured to activate and deactivate the PNG 6 at desired times. In addition, as shown in this example, the control circuitry 15 may also control the gamma ray detector 7.

The output of the gamma ray detector 7 is applied to processing circuitry, which for purposes of this example is shown simply as processor 17. The processor 17 may perform, for example, the calculation of mud velocity as set forth in Equation (1) above. In addition, the processor 17 may perform various other calculations as set forth in the embodiments below. One of ordinary skill in the art will recognize that the processor 17 may be dedicated to the functionality of this invention or, more likely, may be a processor of general functionality to the tool.

Once the processor 17 has completed a desired computation, the processor outputs the result to either a storage medium (for later retrieval) or an output device (for transmission to the surface via a communication channel). Various types of and configurations for such devices exist and are known to those skilled in the art. For the purposes of this explanation, these devices are shown generically as output/storage 19.

Figure 3:
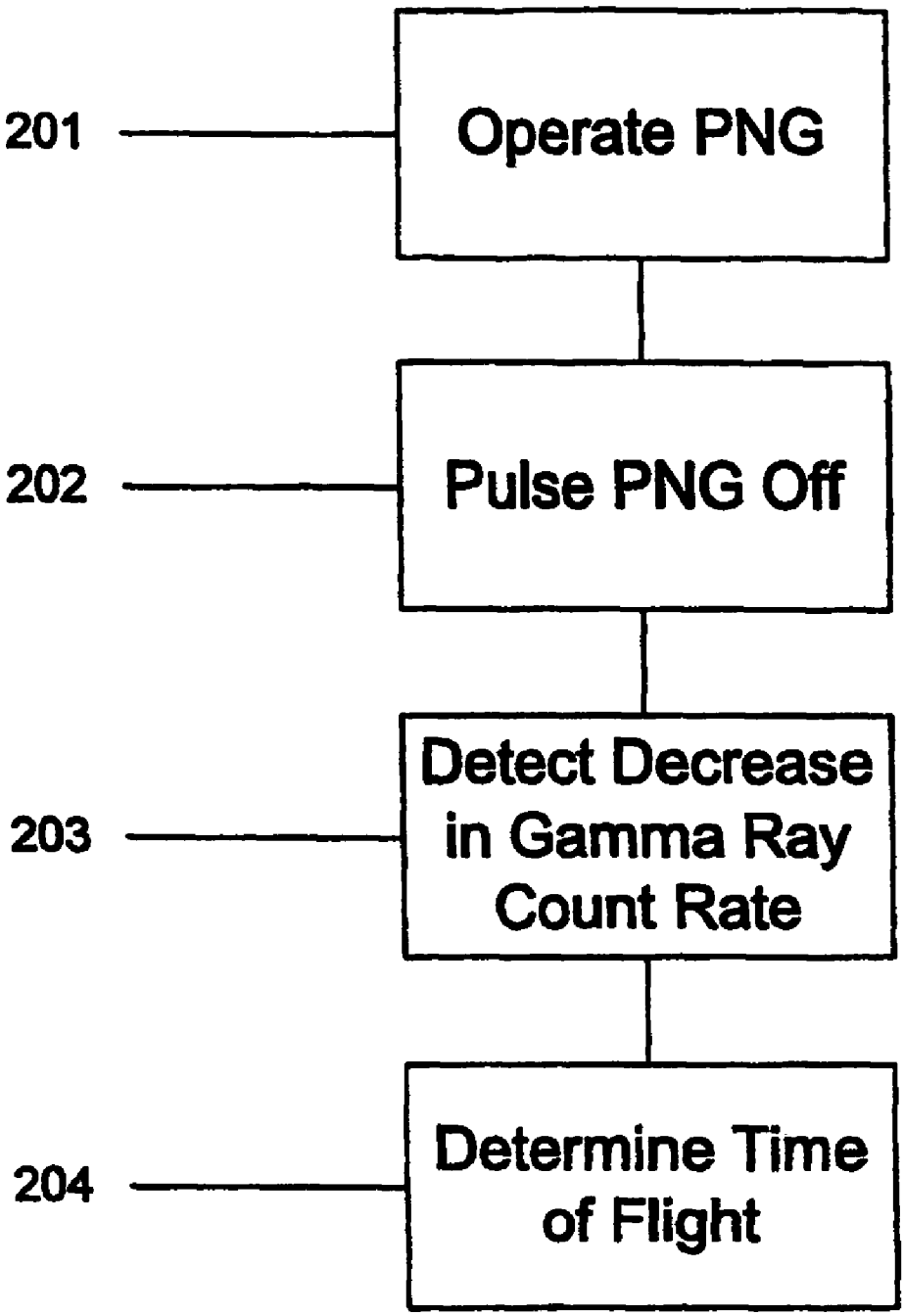
FIG. 3 shows a flow chart of an embodiment of a method of the invention for determining a time-of-flight.

FIG. 3 is a flow chart illustrating the embodiment of the invention, described above, for determining the time-of-flight of drilling mud in an LWD environment. First, shown at step 201, the PNG is operating, i.e., is in a normally "on" state. Next, in step 202, the PNG is pulsed off for a period of time sufficient to allow a slug of mud to flow through the activation zone (11 in FIG. 1) while the PNG is off. The duration of the off pulse is selected such that the size of the unactivated slug is sufficient to cause a detectable decrease in the gamma ray count rate at the gamma ray detector. In step 203, the decrease in the gamma ray count rate is detected at a known distance from the PNG. As noted above, this may be performed using any gamma ray detector known in the art or a detector specific for the gamma rays emitted by the activated oxygen. Then, in step 204, the time-of-flight for the unactivated slug to travel from the PNG to the gamma detector is calculated.

Figure 4:
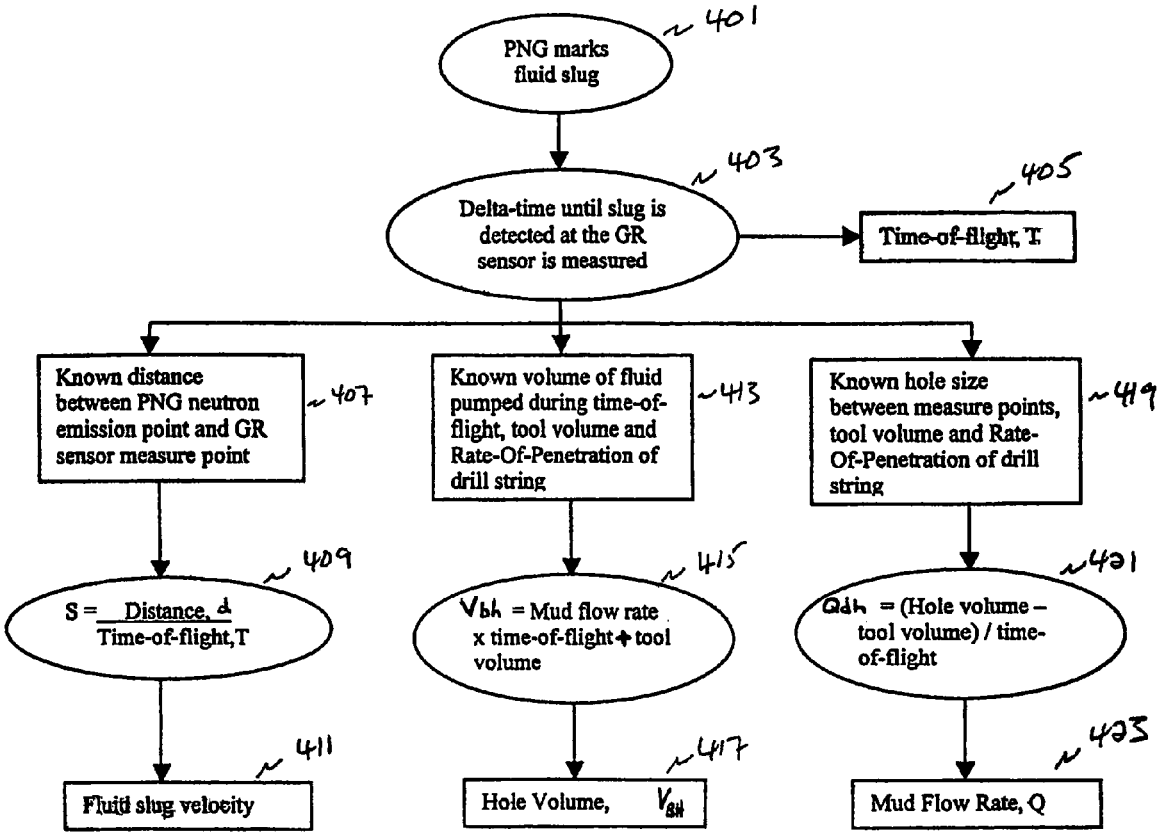
FIG. 4 shows a flow chart of embodiments of the invention for determining various parameters from the time-of-flight.

FIG. 4 is a flow chart illustrating use of the time-of-flight to determine drilling parameters in accordance with various embodiments of the invention. First, as explained in detail above, the PNG is used to mark a slug of fluid (401), and the time until the marked slug is detected by the gamma ray sensor is measured (403). This is the time-of-flight (405). The time-of-flight may then be used to determine other parameters of interest. In one embodiment, given the known distance "d" between the PNG and the gamma ray detector (407), Equation (1) above may be employed (409) to determine mud or fluid slug velocity (411).

As noted above, in the wireline environment the size of the borehole may be measured directly using, e.g., a caliper. However, it is much more difficult to determine the borehole size while drilling. A method according to one embodiment of the invention enables the determination of the size of the borehole while drilling. The mud is pumped into the drill string at a known volumetric flow rate. Assuming that the mud is incompressible, that there is no significant invasion of mud into the formation between the drill bit and the gamma ray detector, that the tool volume is known, and that the Rate of Penetration of the drill string is either known or negligible with respect to the distance "d" (413), the volume of the borehole 2 over the distance "d" can be calculated from the time-of-flight. Specifically, the flow volume in the annulus of the borehole over the distance d may be calculated by multiplying the volumetric flow rate (Q) by the time-of-flight (t). The known volume of the LWD tool 3 over the distance "d" may then be added to the flow volume (415) to determine the volume of the borehole ($V_{bh}$) over the distance "d" (417). Equation 2 shows this relationship:

$$V_{bh}=(Qt)+V_{tool} \tag{2}$$

where $V_{tool}$ is the volume of the LWD tool over the distance "d", Q is the volumetric flow rate of the mud as determined from the pump rate at the surface, and t is the time-of-flight.

The volume of the borehole $V_{bh}$ may, for example, be used to calculate the average borehole diameter $D_{bh}$ over the distance "d". The equation for the volume of a cylinder can be solved for the diameter of the cylinder, as in Equation 3:

$$D_{bh} = 2\sqrt{\frac{V_{bh}}{\pi d}} \tag{3}$$

Some LWD tools may include sensors designed to directly measure the diameter of a borehole during the drilling process. One example of such a sensor is an ultrasonic sensor that determines the diameter of the borehole by measuring the time it takes an ultrasonic pulse to travel through the mud from the LWD tool, reflect off the borehole wall, and return to the LWD tool. If such a sensor is included in an LWD tool, the borehole volume over the distance "d" may be calculated from the diameter. An embodiment of the invention may then be used to make a downhole measurement of the volumetric flow rate of the mud in the annulus. Specifically, assuming the borehole volume is known over the distance "d", that the tool volume is known, and that the ROP is either known or negligibly small with respect to the distance "d" (419), from Equation 2 one may determine the volumetric flow rate of the mud, as shown in Equation (421):

$$Q_{dh} = \frac{V_{bh} - V_{tool}}{t} \tag{4}$$

where t is the time-of-flight, $V_{bh}$ is the volume of the borehole over the distance "d", $V_{tool}$ is the volume of the LWD tool over the distance "d", and $Q_{dh}$ is the volumetric flow rate of the mud in the region between the PNG and the gamma ray detector. Although the volumetric flow rate of the mud is known at the surface, the sub-surface measurement is useful as it provides an indication of fluid loss into the formation (423).

The above-described equations assume that the rate-of-penetration (ROP) of the drill bit is negligible compared to the distance "d". In most circumstances, this assumption will provide good results. Nonetheless, as noted above, the methods of the invention may be adapted to take into account the rate-of-penetration of the drill bit in those cases where it cannot be ignored.

The ROP can be accounted for by reducing the distance between the PNG and the gamma ray detector by the distance traveled by the drill string during the time-of-flight measurement. The distance traveled by the drill string is equal to the ROP times the time-of-flight. Thus, Equation 1 can be rewritten to account for the ROP:

$$V_m = \frac{d - (ROP \cdot t)}{t} \tag{5}$$

where ROP is the rate of penetration, d is the distance between the PNG and the gamma ray detector, t is the time-of-flight, and $V_m$ is the mud flow velocity. Likewise, Equations 2-4 can be adapted to account for the ROP by replacing d with the distance d−(ROP×t).

A method according to the invention could also be used in the downward direction, i.e., while the mud is traveling down the drill string. As described earlier, the mud in the mud channel is activated when it passes through the activation zone 11 near the PNG 6. The PNG 6 may be pulsed off, and the resulting decrease in activation may be detected by a gamma ray detector (not shown) disposed below the PNG 6 in the LWD tool 3. Although, in this embodiment, a gamma ray detector would have to be placed below the PNG in the drill string, the apparatus and methods of the invention described above would not be otherwise changed.

Detection of the time-of-flight of the mud in the drill string may be used to calibrate mud properties under downhole conditions. For example, because the inside volume of the mud channel is known, the time of flight may be used to derive the mud compressibility under downhole conditions. Thus, the above calculation of mud velocity may use this experimentally-determined mud compressibility instead of assuming that the mud is not compressible.

While the invention has been described with respect to a limited number of embodiments, those skilled in the art having benefit of this disclosure, will appreciate that other embodiments can be devised which do not depart from the scope of the invention as disclosed herein. For example, although activation using a PNG has been described for purposes of illustration, any activation device would be usable within the scope of the invention. Accordingly, the scope of the invention should be limited only by the attached claims.

The invention claimed is:

1. A method for determining a downhole parameter in a drilling environment, comprising:

activating, by an activation device, drilling fluid flowing past the activation device;

turning off the activation device for a time sufficient to create an unactivated slug of drilling fluid;

detecting the unactivated drilling fluid slug at a known distance (d) from the activation device;

determining a time-of-flight (t) for the unactivated drilling fluid slug to travel the distance (d); and calculating borehole volume over the distance (d) using a known surface volumetric flow rate.

2. The method of claim 1, further comprising calculating drilling fluid velocity from the time-of-flight (t) and the known distance (d).

3. The method of claim 2, wherein calculating the fluid velocity includes using a rate-of-penetration correction.

4. The method of claim 1, further comprising calculating a borehole diameter from the borehole volume.

5. The method of claim 1, further comprising calculating a downhole volumetric flow rate from the time-of-flight (t) and a known borehole volume.

6. The method of claim 1, wherein the method is performed using a logging-while-drilling tool.

7. The method of claim 1, wherein the fluid flowing past the activation device is flowing toward a surface location.

8. The method of claim 1, wherein the unactivated drilling fluid slug is detected using a gamma ray detector located in a drill string tool the distance d from the activation device.

9. The method of claim 1 wherein the distance d is chosen such that the unactivated drilling fluid slug is detected within about 30 seconds from when it passes the activation device.

10. A tool for determining a downhole parameter in a drilling environment, wherein the tool is adapted to be placed in a drill string and wherein the tool comprises a activation device and a gamma ray detector separated along a drill string axis thereof by a distance (d), the tool further comprising:

control circuitry to turn off the activation device for a time sufficient to create an unactivated slug of drilling fluid flowing past the tool;

processing means, coupled to the gamma ray detector, for determining when the unactivated slug of drilling fluid flows past the gamma ray detector; and wherein the processing means is configured to calculate borehole volume over the distance (d) using a known volumetric flow rate.

11. The tool of claim 10, wherein the processing means further determines a time-of-flight (t) for the unactivated drilling fluid slug to travel the distance (d).

12. The tool of claim 11, wherein the processing means is configured to calculate drilling fluid velocity from the time-of-flight (t) and the known distance (d).

13. The tool of claim 10, wherein the processing means is configured to calculate a borehole diameter from the borehole volume.

14. The tool of claim 11, wherein the processing means is configured to calculate a downhole volumetric flow rate from the time-of-flight (t) and a known borehole volume.

15. The tool of claim 10, wherein the tool comprises a logging-while-drilling tool.

16. The tool of claim 10, wherein the fluid flowing past the activation device is flowing outside the tool.

17. A method for determining a downhole parameter in a drilling environment, comprising:

activating, by an activation device, drilling fluid flowing past the activation device;

turning off the activation device for a time sufficient to create an unactivated slug of drilling fluid;

detecting the unactivated drilling fluid slug at a known distance (d) from the activation device;

determining a time-of-flight (t) for the unactivated drilling fluid slug to travel the distance (d); and calculating a borehole diameter from the borehole volume.

18. A method for determining a downhole parameter in a drilling environment, comprising:

activating, by an activation device, drilling fluid flowing past the activation device;

turning off the activation device for a time sufficient to create an unactivated slug of drilling fluid;

detecting the unactivated drilling fluid slug at a known distance (d) from the activation device;

determining a time-of-flight (t) for the unactivated drilling fluid slug to travel the distance (d); and calculating a downhole volumetric flow rate from the time-of-flight (t) and a known borehole volume.

19. A method for determining a downhole parameter in a drilling environment, comprising:

activating, by an activation device, drilling fluid flowing past the activation device;

turning off the activation device for a time sufficient to create an unactivated slug of drilling fluid;

detecting the unactivated drilling fluid slug at a known distance (d) from the activation device;

determining a time-of-flight (t) for the unactivated drilling fluid slug to travel the distance (d); and calculating drilling fluid velocity from the time-of-flight (t) and the known distance (d), wherein calculating the fluid velocity includes using a rate-of-penetration correction.

* * * * *